US005320224A

United States Patent [19]

Hauenstein et al.

[11] Patent Number: 5,320,224

[45] Date of Patent: Jun. 14, 1994

[54] FLEXIBLE OVERLAY FOR PROTECTING NON-PLANAR PORTIONS OF AN ARTICLE

[75] Inventors: John A. Hauenstein, Rock Hill; Hugh G. Moren, Jr., Hartsville, both of S.C.

[73] Assignee: Star Paper Tube, Inc., Rock Hill, S.C.

[21] Appl. No.: 998,465

[22] Filed: Dec. 30, 1992

[51] Int. Cl.[5] ..... B65D 85/66

[52] U.S. Cl. ..... 206/414; 206/586; 242/68.6

[58] Field of Search ..... 206/396, 413–416, 206/586; 242/68.6

[56] References Cited

U.S. PATENT DOCUMENTS

| | | | |
|---|---|---|---|
| 542,728 | 7/1895 | Duval | 206/414 |
| 1,772,850 | 8/1930 | Wheldon | 206/414 |
| 1,989,182 | 1/1935 | Blake | 206/414 |
| 1,989,183 | 1/1935 | Blake | 206/414 |
| 4,513,864 | 4/1985 | Liebel | 206/396 |
| 4,516,892 | 5/1985 | Curro, Jr. | 206/413 X |
| 4,995,512 | 2/1991 | Liebel | 206/396 |

*Primary Examiner*—Bryon P. Gehman

*Attorney, Agent, or Firm*—Shefte, Pinckney & Sawyer

[57] ABSTRACT

The present invention provides an overlay for overlying an edge, corner, or other non-planar extent of an object. The overlay includes first and second longitudinal portions interconnected to one another to form an included angle of generally 90°. The first longitudinal portion has a plurality of segments, each having opposite end walls which form channels between adjacent segments. Each channel extends from a front channel opening to a longitudinally offset rear channel opening. Due to the channels between the segments, the segments are free to move relative to one another as the overlay is manipulated to conform to the non-planar extent of the object to be protected. At least some partial overlap always obtains between adjacent pairs of the segments so that the overlay provides protection irrespective whether it is overlying a non-planar extent which is generally concave or generally convex in shape.

11 Claims, 6 Drawing Sheets

FLEXIBLE OVERLAY FOR PROTECTING NON-PLANAR PORTIONS OF AN ARTICLE

BACKGROUND OF THE INVENTION

The present invention relates to a flexible overlay for overlying non-planar portions of an article and, more particular, a flexible overlay for overlying the curved or bent edges of an article.

U.S. Pat. No. 4,516,892 to Curro, Jr. discloses a protector for protecting the exposed edges of a hollow core formed by a coil of sheet material. The coil protector includes a pair of identical disks each having an outer annular portion which is joined to the outer annular portion of the other disk, and each having an inner annular portion having a plurality of uniformly spaced cuts therein to form a plurality of tabs. The tabs are bent at a right angle to the outer annular portion and inserted axially into the core to be protected. The tabs of the second disk are cut at an equivalent but opposite or reverse angle to the cuts forming the tabs of the first disk. Accordingly, the tabs of the second disk cover the voids created by the tabs of the first disk when the tabs are disposed axially inwardly of the core to be protected.

The Curro, Jr. core protector aims to improve on another known core protection arrangement which includes deploying a single annular disk having a plurality of V-shaped notches in an inner annular portion to form a plurality of tabs. These tabs are bent inwardly into the core. While the tabs of the single disk offer some protection to the interior of the core adjacent its circumferential edge, the V-shaped voids between the tabs remain and the portions of the core are thus left exposed and unprotected at the V-shaped voids. If a strap is extended through the core of the coiled material, such as is typically done primarily for maintaining the material in its coiled condition, the strap is unsupported in the region of the V-shaped voids and can damage the underlying core area of the coiled material. The same damaging situation occurs as well when the protector is deployed in overlying relationship over the coil of material itself in that the strap is unsupported in the area of the V-shaped voids and can tear or compress the underlying coiled material. However, while the Curro, Jr. core protector advances the state of the art, the need still exists for improvements in protectors of the type which overlay non-planar or edge portions of an article.

SUMMARY OF THE INVENTION

The present invention provides a protective overlay for the edges, corners, and other non-planar portions of the an article which advantageously protects the underlying article portions irrespective of whether the underlying portion has an overall concave or convex shape. According to one aspect of the present invention, there is provided an overlay for overlying a non-planar extent of an object formed by the adjacent regions of a first surface and a second surface not in the same plane as the front surface. The overlay includes a first longitudinal portion and a second longitudinal portion interconnected to the first longitudinal portion along a longitudinally extending connection line with the first and second longitudinal portions forming an included angle of less than 180°. The first longitudinal portion has at least two segments, the two segments forming a channel therebetween and each segment having a front surface on one respective lateral side thereof transverse to the longitudinal extent of the segment and a rear surface on the opposite lateral side thereof. The channel extends between a front channel opening formed between the front surfaces of the two segments and a rear channel opening formed between the rear surfaces of the two segments and longitudinally offset from the front channel opening.

The second longitudinal portion is manipulable about a lateral axis for disposing the second longitudinal portion in overlying relation with the first surface of the non-planar extent of the object and the channel permitting movement of the segments of the first longitudinal portion relatively toward or away from one another to permit the first longitudinal portion to extend in overlying relation with the second surface of the non-planar extent of the object. Preferably, the channel forms an acute angle with the longitudinally extending connection line.

According to other features of the overlay of the present invention, the second longitudinal portion is generally planar and the channel extends to the second longitudinal portion. Also, each segment includes a generally planar end wall extending between the front and rear surfaces of the segments and a respective end wall of one segment forms the channel therebetween with a respective end wall of the other segment. Furthermore, the respective channel forming end walls extend generally parallel to one another.

Preferably, the respective channel forming end walls each extend at an acute angle to the thickness of each segment as measured transversely between the front and rear surfaces of the segment in the range of between 10° to 30°. Also, the arcuate angle at which the respective channel forming end walls extend is preferably in the range between 70° to 80°. Furthermore, the first and second longitudinal portions preferably form an included angle of 90°.

DESCRIPTION OF THE PREFERRED EMBODIMENT

Figure 1:
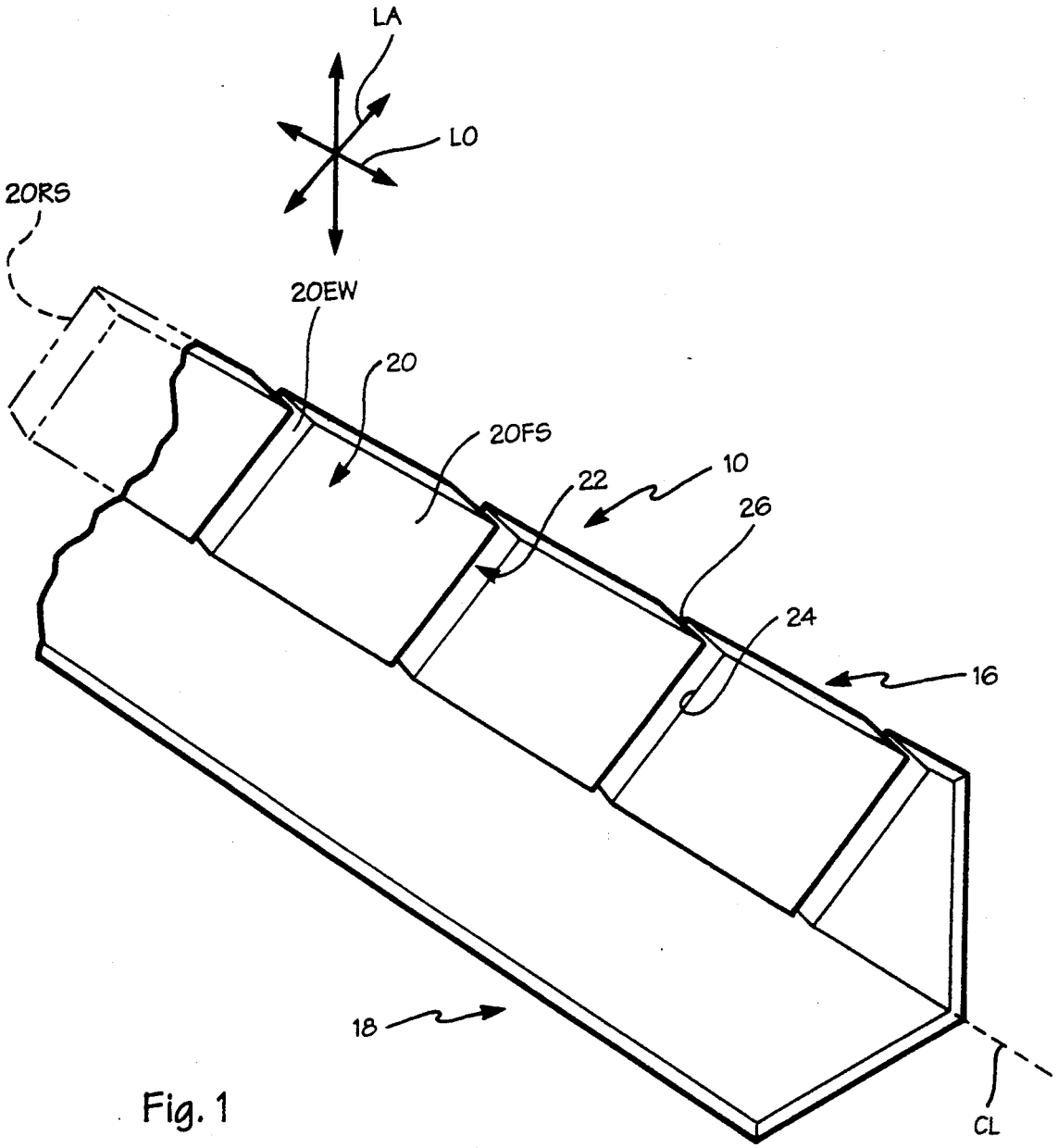
FIG. 1 is an enlarged perspective view of one embodiment of the flexible overlay of the present invention.
Figure 2:
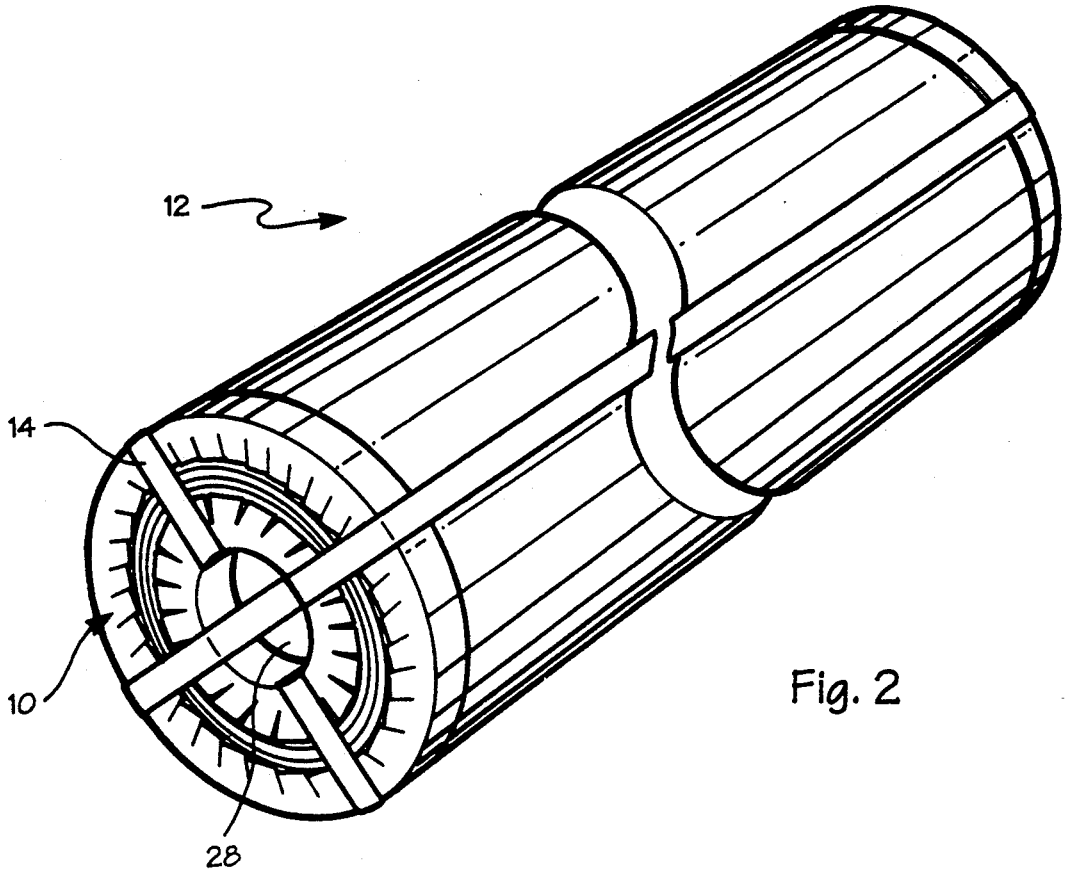
FIG. 2 is a perspective view of a coil of sheet material provided with two units of the flexible overlay of the present invention, with one unit of the flexible overlay being deployed in a concave edge protection configuration and the other unit of the flexible overlay being deployed in a convex edge protection configuration.

As seen in FIG. 1, one embodiment of the flexible overlay 10 of the present invention is particularly adapted for overlying non-planar portions of an article such as, as seen in FIG. 2, the inner and outer cylindrical edges of one axial end of a coil of sheet material 12. The flexible overlay 10 provides protection to the overlaid non-planar portions against weather elements, damaging impacts, or the damaging effects of packaging material such as, for example, conventional coil straps 14 which may be placed around the coil 12 for facilitating handling and movement of the coil. The strapping 14 helps to maintain the sheet material 12 in its coiled disposition. Additionally, the strapping 14 helps to maintain the flexible overlay 10 in its edge protecting disposition when the coil of sheet material 12 is lifted by C-hooks or is secured by chains or the like to a flatbed trailer for transport.

With further reference to FIG. 1, the flexible overlay 10 includes a first longitudinal portion 16 and a second longitudinal portion 18, the longitudinal portions being interconnected to one another along a longitudinally extending connection line CL such that the two longitudinal portions form an included angle of less than 180°. The longitudinal portions 16, 18 may be integrally formed from a single piece of an angle ironshaped material comprised of, for example, paper, plastic, or a combination of natural and synthetic materials. Alternatively, each longitudinal portion 16,18 can be formed from a separate piece of material and the two longitudinal portions may be interconnected to one another such as, for example, along the connecting line CL, by an conventional interconnection method such as, for example, by gluing, welding, fusing, or mechanical interengagement. Additionally, each longitudinal portion 16,18 may be formed of a different material than the other longitudinal portion and other alternative construction arrangements are also possible, it being contemplated that the controlling factors in the formation of the longitudinal portion 16,18 are the desired flexibility, durability, and overlay capability of the flexible overlay 10, as will be discussed in more detail below.

The first longitudinal portion 16 includes a plurality of segments 20 disposed in serial manner along the longitudinal extent of the first longitudinal portion, as viewed along a longitudinal axis LO shown in FIG. 1. Each segment 20 has a front surface 20 FS formed on one respective lateral side thereof relative to a lateral axis LA transverse to the longitudinal axis LO and a rear surface 20 RS on the opposite lateral side of the segment.

Each adjacent pair of the segments 20 includes a pair of end walls 20 EW at opposite ends of the segment and a respective one end wall of each segment is in facing relation to another end wall of an adjacent segment to form a channel 22 therebetween for permitting movement of the respective pair of the segments 20 relative to on another during deployment of the flexible overlay 10 in overlying relationship on an article, as will be described in more detail below. Preferably, the end wall 20 EW of each segment 20, which forms the channel 22 with the facing end wall 20 EW of the respective adjacent segment 20, is planar, whereby each channel 22 is of an elongate parallelepiped shape inclined in the same longitudinal directions as the other channels 22.

Each channel 22 extends between a front channel opening 24 formed between the front surfaces 20 FS of the respective adjacent pair of the segments 20 and a rear channel opening 26 formed between the rear surfaces 20 RS of the respective pair of the segments. Each front channel opening 24 has an elongate parallelepiped shape having a length axis, as viewed along a Y axis transverse to the longitudinal axis LO and the lateral axis LA, and the length axes of the front channel openings 24 are all preferably inclined in the same direction relative to the longitudinal axis LO to form an angle of a uniform magnitude less than 90° relative to the connecting line CL. The uniform acute angle of the longitudinal extent of each front channel opening 24 forms an acute angle with the connecting line CL in the preferred range of 70° to 80°.

Each rear channel opening 26 is formed of an elongate parallelepiped shape, the longitudinal extent of which extends along a plane formed by the longitudinal axis LO and the Y axis. The longitudinal extents of the rear channel openings 26 are preferably inclined in the same direction relative to the longitudinal axis LO and each forms the same acute angle with the connecting line CL.

The front channel opening 2 of each channel 22 is longitudinally offset from the rear channel opening 26 of the channel, as measured relative to the longitudinal axis LO such that the channel 22 formed therebetween preferably forms an acute angle as measured relative to the thickness of the segments 20 (e.g., as measured relative to the lateral axis LA). The preferred acute angle of each channel 22 relative to the lateral axis LA is an angle in the range between 70° to 80°. Although other acute angles outside of this preferred range will still permit deployment of the flexible overlay 10 in the desired manner, it has been found that the orientation of the channels 22 at an acute angle in the preferred range of acute angles facilitates unhindered relative movement between adjacent pairs of the segments 20 during deployment of the flexible overlay 10. A will be described in more detail below, the sliding of each segment 20 relative to an adjacent segment 2 is improved to the extent that the acute angle of each channel 22 to the thickness of the segments 20 is increased.

Figure 3:
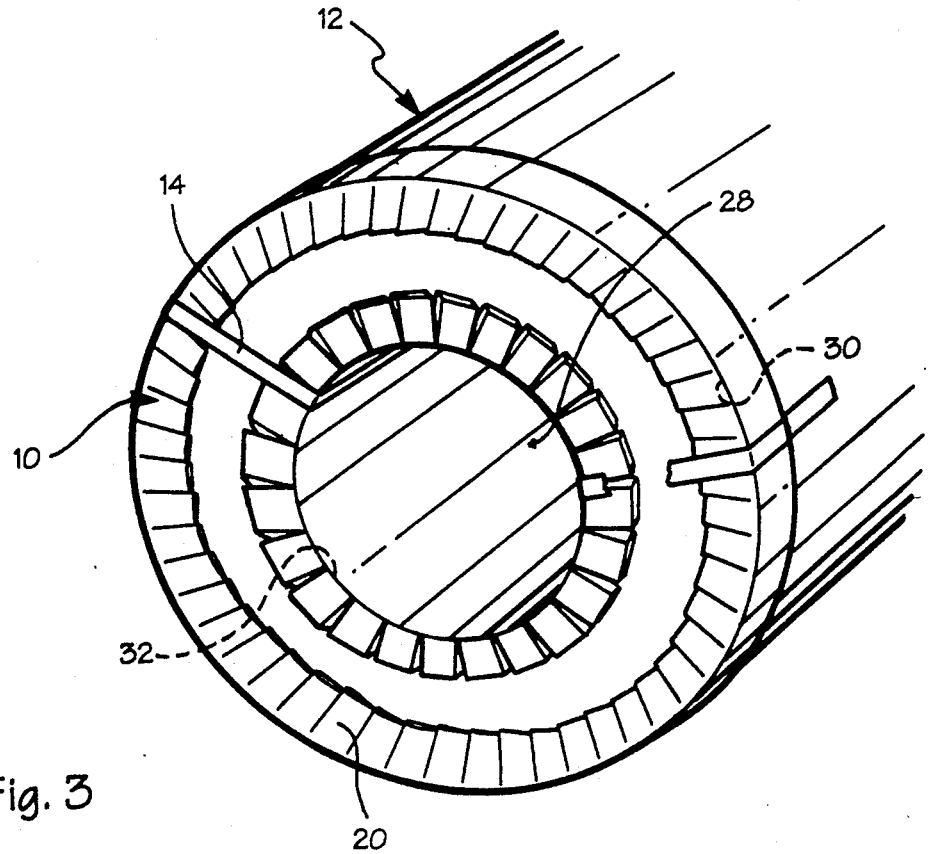
FIG. 3 is an enlarged perspective view of one axial end of the coil sheet material shown in FIG. 2 and showing the two units of the flexible overlay in their deployed configurations.

Depending upon the type of article on which the flexible overlay 10 is to be disposed, and the degree of protection to be provided by the flexible overlay, the flexible overlay 10 can be formed of a length sufficient to extent over the entirety of the overlaid edge portions of the article or of shorter selected lengths to extend only over selected portions of an edge of the article. For example, as seen in FIGS. 2 and 3, the flexible overlay may be deployed to protect the inner and outer circumferential edge portions of one axial end of the coil 12, which may comprise paper, metal, or some other material. If the coil 12 is to be provided with a plurality of the straps 14, it may desirable to form the flexible overlay 10 of a length sufficient to allow deployment of the flexible overlay entirely around the respective cylindrical edge on which it is deployed to thereby provide full flexibility for the positioning of the straps 14 on the coil 12.

Figure 4A:
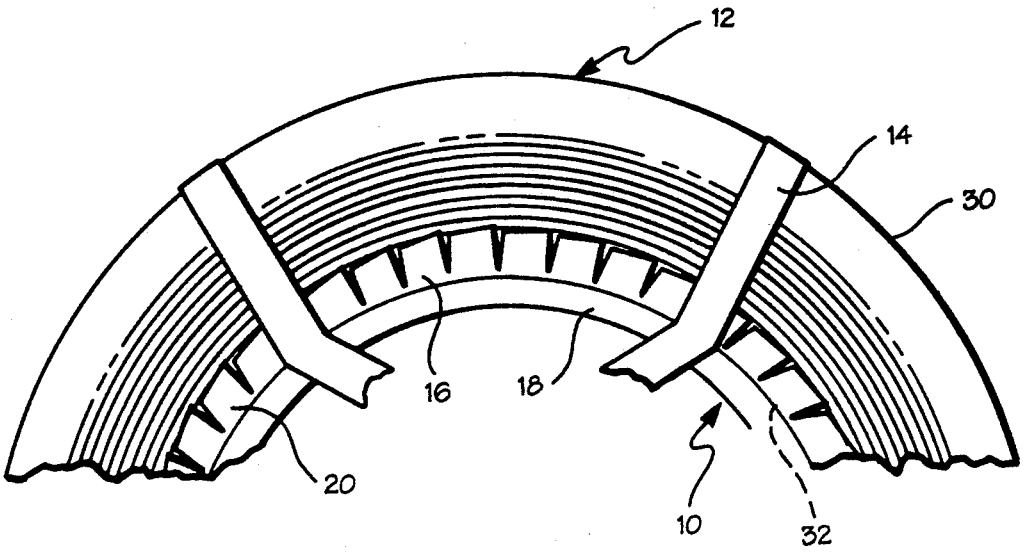
FIG. 4*a* is an enlarged perspective view of one end of a coil of sheet material and showing a flexible overlay of the present invention deployed in a convex edge protection configuration.

Typically, each strap 14 extends in the closed loop axially along the outer circumferential surface of the coil 12, across the annular planar surface of one axial end of the coil 12 from the outer circumferential surface of the coil to the core 28, axially along the core 28, and across the annular planar surface of the other axial end of the coil 12. The straps 14, which are typically mounted on the coil 12 at angularly spaced dispositions from one another, facilitate lifting and other manipulation of the coil 12 and so it is often desirable that the straps 14 be cinched relatively tightly so as to avoid slippage of the straps 14 on the coil 12. However, cinching or tightly mounting a strap 14 on the coil 12 exerts compressive forces on the sheet material bound on the coil 28 and tends to compress the edges of the material over which the straps extends. For example, as seen in FIG. 4*a*, each strap 14 exerts a compressive force on an outer circumferential edge 30 of the sheet material forming the coil 12. To minimize the detrimental effects of the compressive action of the straps 14 on the sheet material such as, for example, tearing or distortion of the sheet material, the flexible overlay 10 can be deployed in an edge protection configuration in which the flexible overlay is interposed between the strap 14 and the sheet material. In its interposed position, the flexible overlay 10 itself at least partially absorbs and blunts the detrimental compressive action of the straps 14 extending thereacross and thereby protects the respective edge portion on which the flexible overlay has been disposed in overlying relationship with the sheet material.

Figure 4B:
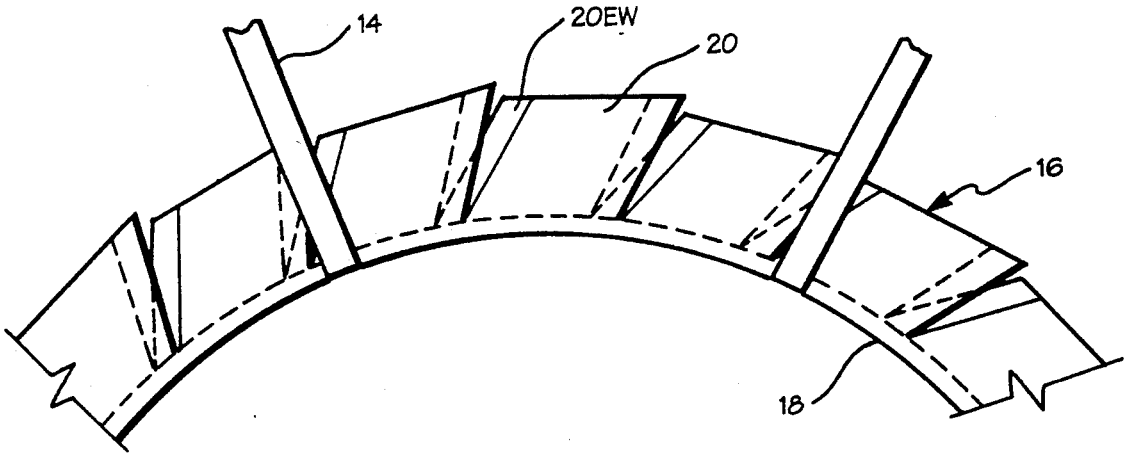
FIG. 4*b* is an enlarged front elevational view of the flexible overlay shown in FIG. 4*a;*
Figure 5A:
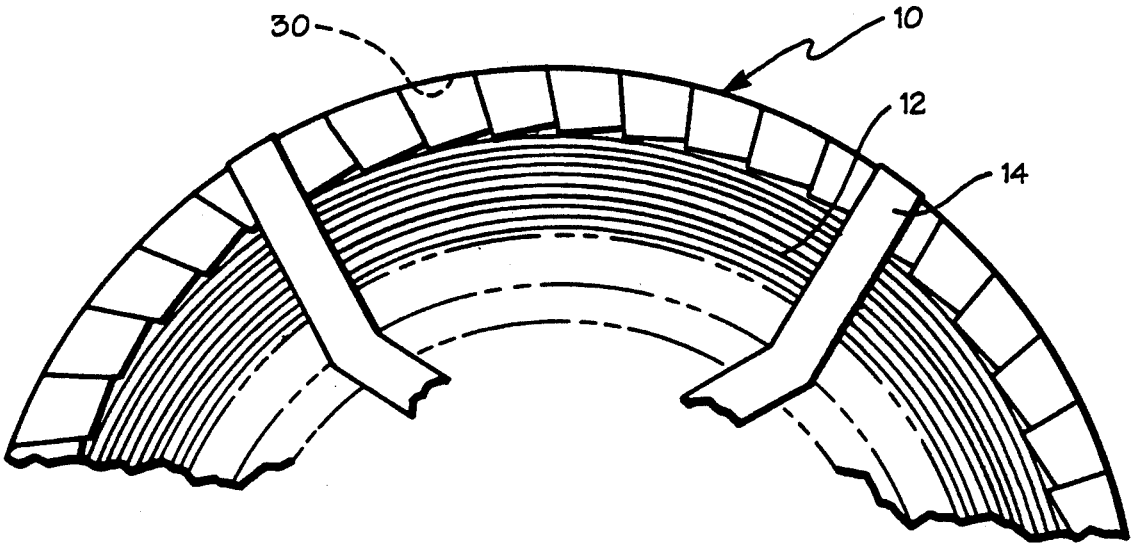
FIG. 5*a* is a perspective view of one axial end of a coil of sheet material and showing one unit of the flexible overlay of the present invention deployed in a concave edge protection configuration on the coil of sheet material.
Figure 5B:
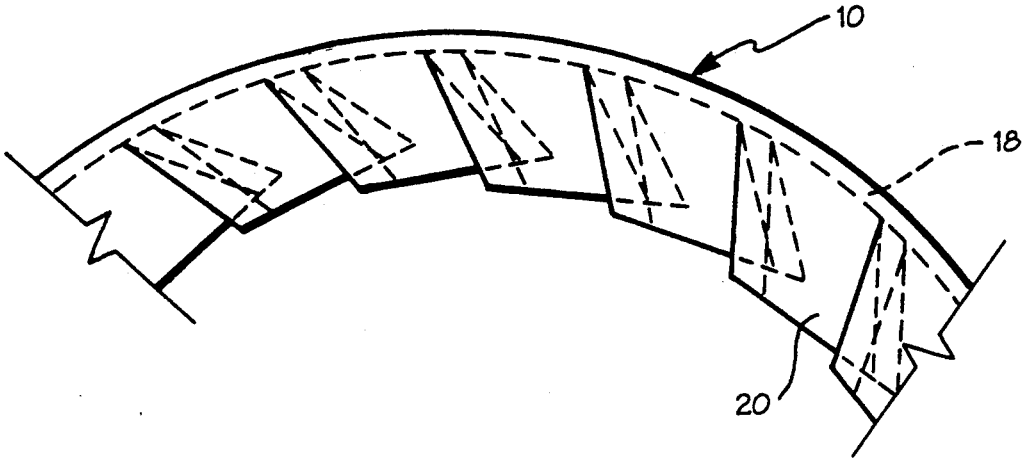
FIG. 5*b* is an enlarged front perspective view of a portion of the flexible overlay shown in FIG. 5*a;*

As seen in FIGS. 2 and 3, any number of units of the flexible overlay 10 may be deployed on a respective article to be protected. In the particular deployment situation illustrated in FIGS. 2 and 3, both the outer circumferential edge 30 and an inner circumferential edge 32 (on the axial end of the coil 12) are each individually protected by a separate unit of the flexible overlay 10. Alternatively, as desired or dictated by the particular article protection situation, the article such as the coil 12 may be provided with the flexible overlays 10 only at particular edge portions. For example, as seen in FIGS. 4*a* and 4*b*, the flexible overlay 10 may be deployed to protect the inner circumferential edge 3 while the outer circumferential edge 30 is left unprotected. Alternatively, as seen in FIGS. 5*a* and 5*b*, the flexible overlay 10 may be deployed to protect only the outer circumferential edge 30 while the inner circumferential edge 32 is left unprotected.

Figure 6:
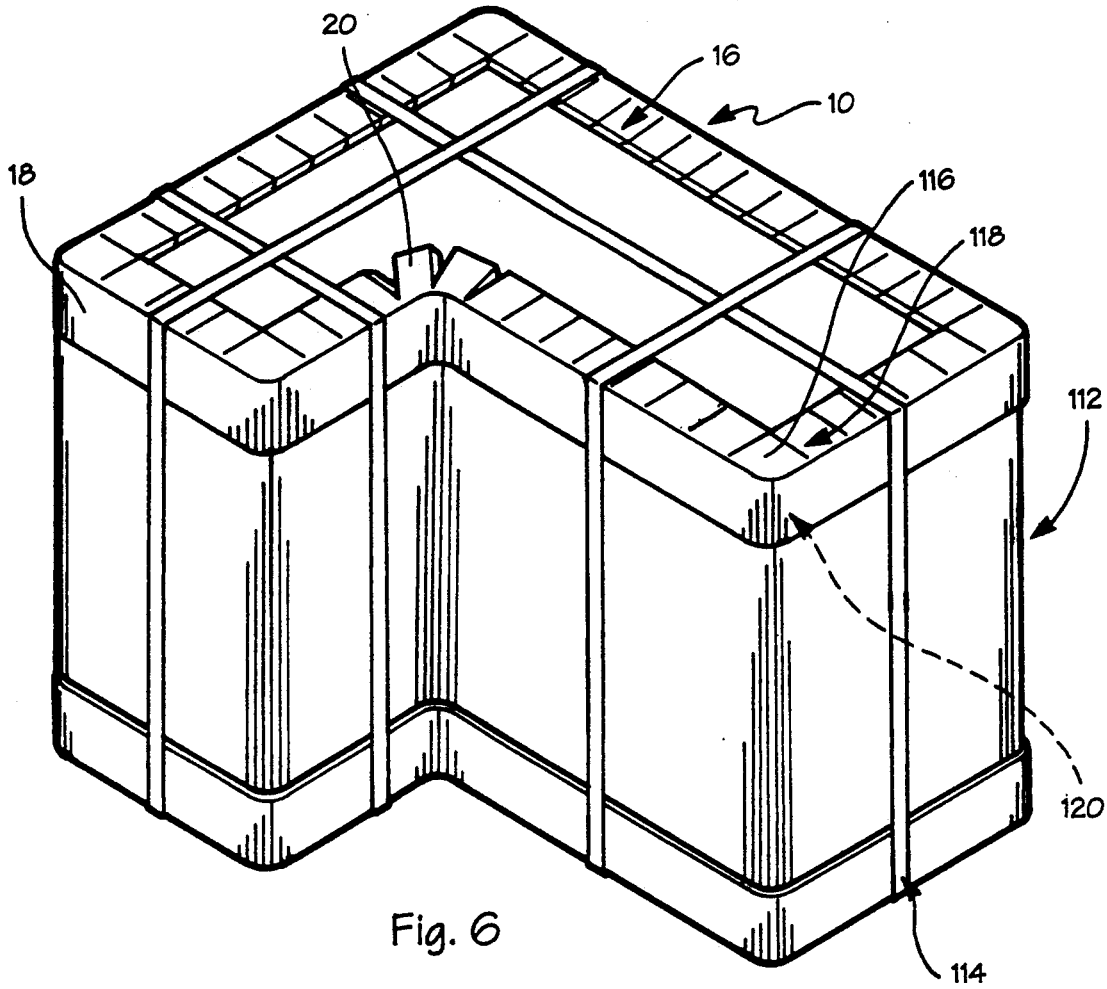
FIG. 6 is a perspective view of a package article and showing a flexible overlay of the present invention deployed in an edge protecting configuration thereon.
Figure 7:
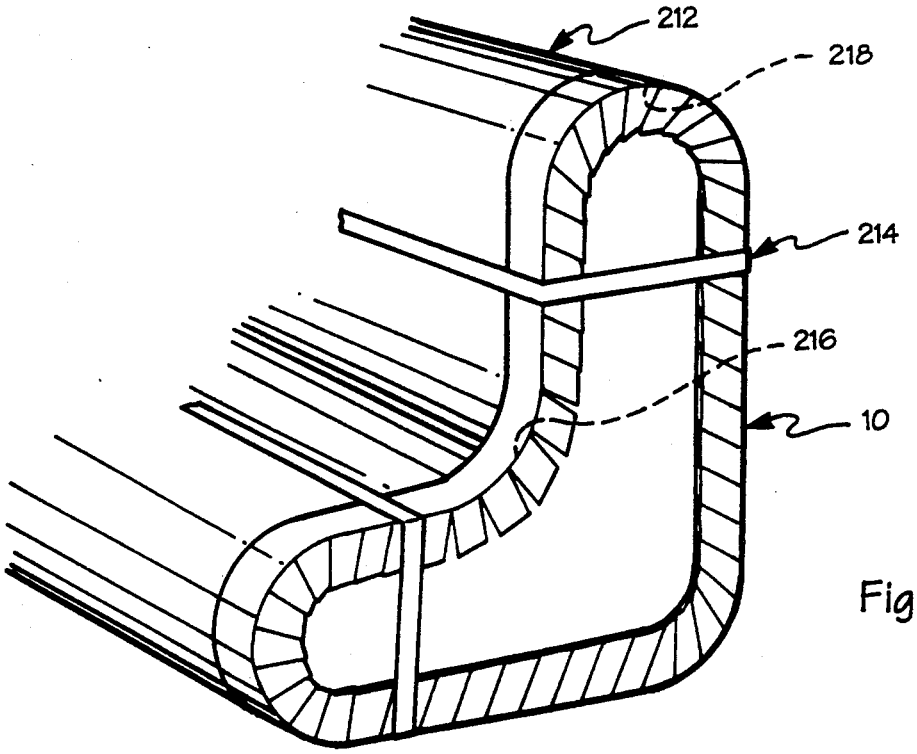
FIG. 7 is a perspective view of one axial end of a package article and showing a flexible overlay of the present invention deployed in an edge protecting configuration thereon.
Figure 8:
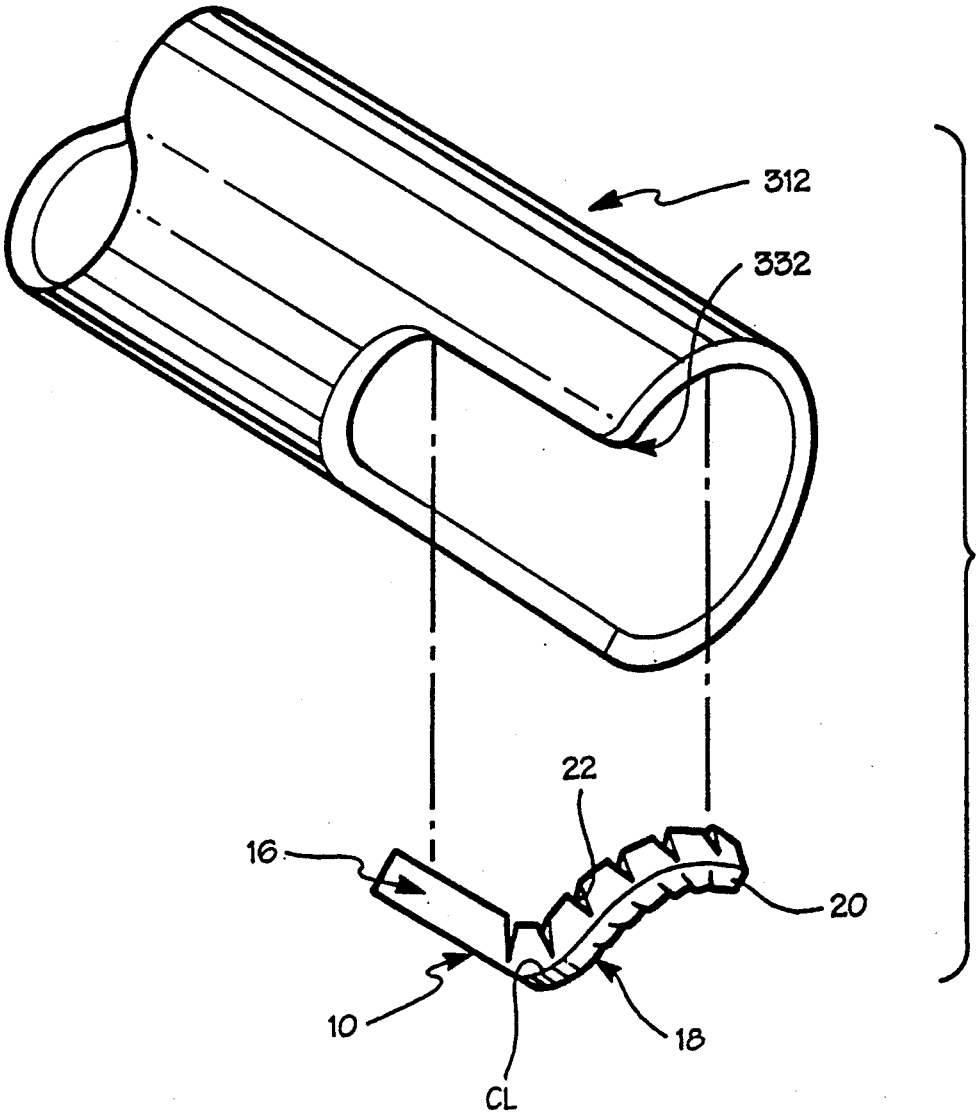
FIG. 8 is a perspective view of one axial end of a conduit article and showing, in exploded manner, a flexible overlay of the present invention deployed for protecting an edge of the conduit article.

FIGS. 6–8 each illustrate a different article on which the flexible overlay 10 can be deployed. In FIG. 6, the article to be overlaid is a generally L-shaped container 12. As seen in FIG. 7, another article which the flexible overlay 10 can protect is a generally V-shaped container 212. As seen in FIG. 8, the flexible overlay 10 can be deployed to protect an edge portion 332 of a slotted end of a cylindrical conduit 312.

The deployment of the flexible overlay 10 into its edge protecting configuration is as follows. As seen in FIGS. 4*a* and 4*b*, if it is desired to protect an edge portion having a concave shape such as, for example, the inner circumferential edge 32, the flexible overlay 10 is deployed as follows into its edge protecting configuration. The longitudinal portion 18, which may itself have a plurality of channels formed therein or as illustrated in FIG. 1, may be formed of a continuous, unbroken surface, is manipulated, to generally conform to the curvature of the respective edge portion to be protected, e.g., by bending about a lateral axis. The longitudinal portion 18 is bent about a lateral axis on the side of the longitudinal portion 18 opposite to the side thereof from which the longitudinal portion 16 extends to generally conform to the circular shape of the inner circumferential edge 32 for subsequent insertion of the longitudinal portion 18 axially into the core 28. As seen in FIGS. 4*b*, the action of bending the longitudinal portion 18 about a lateral axis effects corresponding movement of the segments 20 in the other longitudinal portion 16 relative to one another. In the particular situation in which the flexible overlay 10 is being deployed to cover a concave edge portion, the segments 20 are moved relatively away from adjacent segments due to the bending of the longitudinal portion 18. The channels 22 permit unhindered relative movements of the segments 20 in that the channels 22 allow unhindered sliding movement of the respective facing pairs of the end walls 20 EW forming the channels. In this regard, the planar shape of the end walls 20 EW facilitates smooth sliding relative movement between respective pairs of the end walls. However, the present invention also contemplates that the end walls 20 EW may also be of a suitable non-planar shape which, preferably, does not interfere with or hinder the relative movement of adjacent segments 20.

It should be noted that reference to a "concave" edge portion is intended to be a reference to a broad range of edge portions of different shapes and characteristics, with the edge portions sharing the common feature that the respective surface of the edge portion o which the longitudinal portion 18 is to be deployed in overlying relation has an overall concave shape. Accordingly, the term "concave" is to be understood as referring to a surface of an edge portion which is, for example, not rounded or arcuate as well as to an edge portion comprised of angled linear segments, so long as the overall shape of the respective surface is concave. Likewise, the term "convex" is to be understood as referring to the shape of a broad range of edge portions of different characteristics with the edge portions sharing a common characteristic that the respective surface of the edge portion on which the longitudinal portion 18 is deployed has an overall convex shape. For example, as seen in FIG. 8, the article 312 includes a convex edge portion 332 on which the longitudinal portion 18 of the flexible overlay 10 is deployed. Also, the term "non-planar portion" of an article refers to the adjacent region of a first surface of the article and a second surface of the article which is not in the same plane as the first surface as well as the region intermediate the adjacent regions of the two surfaces. Thus, an edge formed by junction of two planar surfaces is a "non-planar portion". Also, two surfaces spaced from one another whose imaginary extensions intersect form a "non-planar portion" with the open area between two surfaces being the "intermediate region" between the adjacent regions of the two surfaces.

To facilitate insertion of the longitudinal portion 18 into the core 28, the longitudinal portion 18 may initially be bent into a circular shape of a diameter slightly less than the diameter of the core 28. Once the longitudinal portion 18 has been inserted axially into the core 28, the bending force on the longitudinal portion 18 can be released or relaxed to allow the inherent springiness of the material comprising the flexible overlay 10 to radially expand the longitudinal portion 18 from its initial, slightly smaller diameter into conformance with the inner circumferential surface of the coil 12 which forms the core 28. The segments 20 of the other longitudinal portion 16, which are in their spaced but still partially overlapping relationships as seen in FIG. 4*b*, extend in overlying relationship over the other respective surface forming the edge portion to be protected. In the exemplary overlay application shown in FIGS. 4*a* and 4*b*, the longitudinal portion 16 extends over the annular, generally planar surface formed by the ends of the sheet materials between the outer circumferential edge 30 and the inner circumferential edge 32.

While the end walls 20 EW of adjacent pairs of the segments 20 do not fully overlap one another when the flexible overlay 10 is deployed in the manner just described, the end walls 20 EW nonetheless partially overlap one another, as seen in FIG. 4*b*, and thereby provide complete overlying protection to at least some of the respective underlying surface of the edge portion of the article. Moreover, the partially overlapping end walls 20 EW combine with the front surfaces 20 F of the segments 20 to provide an interposed buffer between the strap 14 and the underlying surface of the article 12. As seen in FIG. 4*b*, those respective pairs of the end walls 20 EW over which the strap 14 extends are pressed by the constrictive action of the strap 14 against one another and together provide a buffer, along with the contiguous front surfaces 20 FS of the respective adjacent segments 20, between the strap 14 and the underlying surface of the article 12. While some partial overlap of the end walls 20 EW of each adjacent pair of segments 20 always obtains due to the longitudinally offset relationship of the respective rear channel opening 26 and the associated front channel opening 24, the magnitude of the overlap is proportional to the uniform acute angle of the front channel opening 24 to the connecting line CL. As the front channel opening 24 is increasingly skewed, the acute angle decreases and the magnitude of the overlap of adjacent segments 20 increases so that the overlapped portions of the end walls 20 EW are that much more effective in protecting the underlying edge portion of the coil 12 from the strap 14. Conversely, as this acute angle increasingly approaches 90°, the magnitude of the overlap decreases, although, as previously noted, some overlap will always obtain due to the longitudinally offset relationship of the front and rear channel openings.

Furthermore, the longitudinal portion 18 also acts as a protective buffer between the straps 14 and the respective underlying surface of the edge portion of the coil 12 and the junction of the longitudinal portions 16,18, provides, as well, protection for the edge portion. While the extent of overlap of the end walls 20 EW of the segments 20 varies in dependence upon the degree of bending of the longitudinal portion 18 according to the relationship that the greater the bending, the less the end walls 20 EW of respective facing pairs of the segments 20 overlap one another, at least some partial overlap of the end walls 20 EW always obtains.

As seen in FIGS. 5*a* and 5*b*, the flexible overlay 10 can be deployed to protect an edge portion of an article in such a manner that the segments 20 of the flexible overlay are moved relatively toward one another, in contrast to the deployment of the flexible overlay as illustrated in FIGS. 4*a* and 4*b* in which the segments 20 are moved relatively away from one another in the deployment of the flexible overlay. As seen in particular in FIG. 5*b*, the deployment of the flexible overlay 10 in a manner in which the segments 20 are moved toward one another may, in many circumstances, enhance the protective capability of the flexible overlay, as the degree of overlap between adjacent segments 20 is increased and this provides the benefit that the overlaid surface of the edge portion is partially covered by a "double thickness" of the segments 20. To deploy the flexible overlay 10 in a manner which increases the overlap between adjacent pairs of the segments 20, the longitudinal portion 18 is bent about a lateral axis on the same side of the longitudinal portion 18 from which the longitudinal portion 16 extends to conform the longitudinal portion to the general overall curvature of the edge portion to be covered such as, for example, the outer circumferential edge 30. As the longitudinal portion 18 is conformed to the desired curvature, the facing pairs of the end walls 20 EW of respective adjacent pairs of the segments 20 slide relative to one another with the result that the rear surface 20 RS of one of the segments 20 of each pair of segments partially overlaps the front surface 20 FS of the other segment 20.

As seen in FIGS. 2 and 3, the coil 12 can be provided with one unit of the flexible overlay 10 for protecting the outer circumferential edges 30 and, additionally, with a second unit of the flexible overlay 10 for protecting the inner circumferential edge 32. This arrangement provides the additional benefit that the extent of each strap 14 extending between the outer circumferential edge 30 and the inner circumferential rods 32 is substantially completely supported out of contact with the axial ends of the sheet material of the coil 12 by the two units of the flexible overlay 10, thereby reducing the overall direct surface-to-surface contact between the strap 14 and the sheet material.

The flexible overlay 10 can comprise a mixture of segments some of which are designed to move relative to one another along channels such as the channels 22 extending between longitudinally offset front and rear channel openings while others of the segments are separated by channels which have longitudinally offset front and rear channel openings but are at a right angle to the longitudinal portion 18'. For example, the flexible overlay 10, as seen in FIG. 6, may comprise a mixture of the segments 20 and a plurality of squared segments 116. The squared segments 116 are arranged such that every squared segment is contiguous to another squared segment and is separated by a channel 118 formed at a right angle to the connecting line CL between the longitudinal portions 16,18 and extending between a front channel opening and a rear channel opening longitudinally offset from one another. The squared segments 116 are provided to enable the flexible overlay 10 to extend over certain areas of an edge portion, such as a right angled corner, without any portion of the overlay extending outwardly beyond the container.

Adjacent ones of the segments 20 move relative to one another as the longitudinal portion 18 is conformed to one respective surface of the particular edge portion of the container 112 being protected with the segments 20 at least partially overlapping one another to provide edge protection. The adjacent ones of the segments 116 also move relative to one another as the longitudinal portion 18 is conformed to the container 112. For example, as seen in FIG. 6, the longitudinal portion 18 is extended around a right angle corner 120 of the container 112, and one of the segments 116 is substantially completely overlapped by an adjacent segment 116 with the right angle-oriented channel between the pair of the segments 116 permitting the overlapping movement of the pair of segments while ensuring that the topmost segment (e.g., the respective segment 116 overlapping the other segment 116) does not extend outwardly beyond the edge of the container 112. If, instead, a pair of the segments 20 were disposed at the right angle corner 120, the overlapping one of the segments 20 would extend outward of the edge portion of the container 112 due to the angled orientation of the channel 22 between the pair of the segments 20.

As seen in FIG. 7, the flexible overlay 10 can be adapted to protect an edge portion of the V-shaped article 212 and this configuration illustrates the versatility of a single unit of the flexible overlay 10 in handling an edge portion having both concave and convex segments. The segments 20 of the flexible overlay 10 move relatively away from one another to accommodate a convex segment 216 of the edge portion of the container 212 while other segments move relatively toward one another into greater overlapping relationship to accommodate a concave segment 218 of the edge portion of the container. The flexible overlay 10 thus protects both the concave and convex shaped edge portions of the container 212 against the detrimental compressive and rubbing effects of a plurality of straps 214 disposed around the container.

FIG. 8 illustrates an edge protection situation in which each of the longitudinal portions 16,18 of the flexible overlay 10 are provided with the segments 20 and the channels 22 therebetween to provide the flexible overlay with the capability to overlay an edge portion have complex curvature. In this exemplary edge protection situation, the cylindrical conduit 312 has a slotted end which forms the edge portion 332 and the flexible overlay 10 is deployed to protect this edge portion. The configuration of the flexible overlay 10 shown in FIG. 8 exemplarily illustrates that the center line CL formed by the junction of the longitudinal portion 16 and 18 does not necessarily have to be of a linear center line but, instead, can itself have a complex curvature, as the situation requires.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An overlay for overlying a non-planar extent of an object formed by the adjacent regions of a first surface and a second surface not in the same plane as the first surface, comprising:

a first longitudinal portion having an outer surface and inner surface; and a second longitudinal portion having an outer surface and an inner surface interconnected to the first longitudinal portion along a longitudinally extending connection line with the first and second longitudinal portion inner surfaces forming an angle therebetween of less than 180°, said first longitudinal portion having at least two segments each having a predetermined thickness, said at least tow segments having means for forming a channel therebetween and each segment having a front surface on one respective lateral side thereof transverse to the longitudinal extent of the segment and a rear surface on the opposite lateral side thereof and said channel-forming means extending between a first channel opening formed between the front surfaces of said at least two segments and a rear channel opening formed between the rear surfaces of said at least two segments and longitudinally offset from the front channel opening, said second longitudinal portion being manipulable about a lateral axis for disposing the second longitudinal portion in overlying relation with the first surface of the non-planar extent of a said object and said channel-forming means permitting movement of the segments of the first longitudinal portion relatively toward or away from one another to permit the first longitudinal portion to extend in overlying relation with the second surface of the non-planar extent of the object.

2. An overlay according to claim 1 wherein said channel-forming means forms an acute angle with the longitudinally extending connection line.

3. An overlay according to claim 2 wherein the second longitudinal portion is generally planar and each said at least one channel extends to the second longitudinal portion.

4. An overlay according to claim 2 wherein said channel-forming means of each segment includes a generally planar end wall extending between the front and rear surfaces of each segment and a respective end wall of one segment forms said channel with a respective end wall of an adjacent segment.

5. An overlay according to claim 4 wherein said channel-forming end walls extend generally parallel to one another.

6. An overlay according to claim 5 wherein the respective channel-forming end walls each extend at an acute angle to the thickness of each segment as measured transversely between the front and rear surfaces of the segment in the range of between 10° to 30°.

7. An overlay according to claim 6 wherein said acute angle at which the respective channel forming end walls extend is in the range between 70° to 80°.

8. An overlay according to claim 6 wherein the first and second longitudinal portions form an angle therebetween of 90°.

9. An overlay for overlying a non-planar extent of any object formed by the adjacent regions of a first surface and a second surface not in the same plane as the first surface, said overlay comprising a first longitudinal portion; and a second longitudinal portion interconnected to the first longitudinal portion along a longitudinally extending connection line, said second longitudinal portion being bendable about said connection line with respect to said first longitudinal portion, said first longitudinal portion being formed with a plurality of traversly extending, adjacent segments, each segment having an outer surface and an inner surface, a predetermined thickness and a cross section formed as a parallelogram having no right angles along an extent transverse to said connection line with said outer surface being longitudinally offset with respect to said inner surface defining a spacing formed as a parallelogram having no right angles between said adjacent segments having said outer surface of adjacent segments extending beyond said inner surface of adjacent segments in an overriding relationship, said second longitudinal portion being bendable about a lateral axis for disposing said second longitudinal portion in overlying relation with the first surface of the non-planar extent of an object and said spacing formed as a parallelogram having no right angles permitting movement of said plurality of segments relatively toward or away from one another in an overriding relationship to permit the first longitudinal portion to extend in overlying relation with the second surface of the non-planar extent of the object, said predetermined thickness providing a cushioning effect to protect the object from impact.

10. An overlay according to claim 9 wherein said segments include end walls extending between said outer surface and said inner surface, each said end wall forming an angle with each said outer surface of a predetermined value.

11. An overlay according to claim 10 wherein each said end wall forms an angle with each said outer surface of less than 90°.

* * * * *

UNITED STATES PATENT AND TRADEMARK OFFICE
CERTIFICATE OF CORRECTION

PATENT NO. : 5,320,224

DATED : June 14, 1994

INVENTOR(S) : John A. Hauenstein and Hugh G. Moren, Jr.

It is certified that error appears in the above-identified patent and that said Letters Patent is hereby corrected as shown below:

Column 1, line 8, delete "particular" and insert therefor -- particularly --.

Column 1, line 54, delete "the" (first occurrence).

Column 2, line 35, delete "arcuate" and insert therefor -- acute --.

Column 3, line 45, delete "an" and insert therefor -- a --.

Column 4, line 3, delete "on" and insert therefor -- one --.

Column 4, line 35, delete "2" and insert therefor -- 24 --.

Column 4, line 50, delete "A" and insert therefor -- As --.

Column 4, line 52, delete "2" and insert therefor -- 20 --.

Column 4, line 59, delete "extent" and insert therefor -- extend --.

Column 4, line 62, after "overlay" insert -- 10 --.

Column 4, line 67, after "may" insert -- be --.

Column 5, line 20, delete "straps" and insert therefor -- strap --.

Column 5, line 48, delete "3" and insert therefor -- 32 --.

Column 5, line 57, delete "12" and insert therefor -- 112 --.

UNITED STATES PATENT AND TRADEMARK OFFICE
CERTIFICATE OF CORRECTION

PATENT NO. : 5,320,224

DATED : June 14, 1994

INVENTOR(S) : John A. Hauenstein and Hugh G. Moren, Jr.

It is certified that error appears in the above-identified patent and that said Letters Patent is hereby corrected as shown below:

Column 6, line 11, delete "FIGS. 4b" and insert therefor -- FIG. 4b --.

Column 6, line 34, delete "o" and insert therefor -- on --.

Column 7, line 23, delete "20 F" and insert therefor -- 20 FS --.

Column 8, line 31, delete "rods" and insert therefor -- edge --.

Column 8, line 44, after "18" delete " ' ".

Column 10, line 12, delete "tow" and insert therefor -- two --.

Signed and Sealed this

Seventeenth Day of January, 1995

*Attest:*

*Attesting Officer*

BRUCE LEHMAN

*Commissioner of Patents and Trademarks*